United States Patent [19]

Dickmanns et al.

[11] 3,993,437

[45] Nov. 23, 1976

[54] PROCESS FOR THE DYEING OF POLYAMIDE FIBERS WITH SULPHUR DYESTUFFS

[75] Inventors: Heinz Dickmanns, Frankfurt am Main; Karl-Heinz Keil, Offenbach, Main; Joachim Ribka, Offenbach, Main-Burgel, all of Germany

[73] Assignee: Cassella Farbwerke Mainkur Aktiengesellschaft, Germany

[22] Filed: Oct. 29, 1974

[21] Appl. No.: 518,262

[30] Foreign Application Priority Data

Nov. 13, 1973 Germany ..... 2356548

[52] U.S. Cl. ..... 8/21 B; 8/37; 8/178 R

[51] Int. Cl.[2] ..... D06P 3/82

[58] Field of Search ..... 8/21 B, 37, 178 R

[56] References Cited

UNITED STATES PATENTS

| | | | |
|---|---|---|---|
| 2,663,612 | 12/1953 | Gibson | 8/34 |
| 2,848,296 | 8/1958 | Heller | 8/55 |
| 3,164,436 | 1/1965 | Altermatt | 8/39 |

FOREIGN PATENTS OR APPLICATIONS

| | | |
|---|---|---|
| 1,058,017 | 4/1959 | Germany |
| 1,246,757 | 9/1971 | United Kingdom |

OTHER PUBLICATIONS

Schmidlin, "Preparation and Dyeing of Synthetic Fibers," (Chapman & Hall, 1963) pp. 152–161.

*Primary Examiner*—Joseph L. Schofer
*Assistant Examiner*—A. L. Clingman
*Attorney, Agent, or Firm*—Connolly and Hutz

[57] ABSTRACT

Single bath dyeing of polyamide fibers and blends of polyamide and cellulose fibers with aqueous solutions of reduced sulphur dyestuffs containing, as a dye accelerator, compounds of the formula

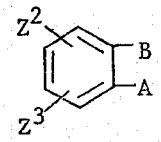

wherein:

A taken separately is hydrogen, halogen, hydroxy or alkoxy or alkyl having 1 to 4 carbon atoms;

B taken separately is —COOR[1] or —Y—Z[1]—M or

A and B taken together are of the formula

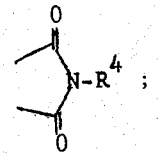

Y is a direct bond, —0—, —S— or —CO—;

Z[1] is alkylene having 1 to 4 carbon atoms or alkenylene having 2 to 4 carbon atoms;

M is —COOR[2] or

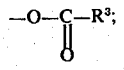

Z[2] is hydrogen, halogen, hydroxy or alkyl or alkoxy having 1 to 4 carbon atoms;

Z[3] is hydrogen, halogen, hydroxy, alkyl or alkoxy having 1 to 4 carbon atoms or when B is —COOR[1], Z[3] may be —COOR[1];

R[1] and R[2] are the same or different and are alkyl having 1 to 6 carbon atoms; alkenyl having 2 to 6 carbon atoms; one of said alkyl or alkenyl radicals substituted by alkoxy-alkoxy having 2 to 8 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by halogen, hydroxy or alkoxy or alkyl having 1 to 4 carbon atoms;

R[3] is alkyl having 1 to 8 carbon atoms and

R[4] is hydrogen, alkyl having 1 to 8 carbon atoms, phenyl, alkenyl having 2 to 4 carbon atoms or haloalkyl, dihaloalkyl, cyanoalkyl, hydroxyalkyl, alkanoyloxyalkyl, alkoxyalkyl or phenylalkyl, each alkyl moiety having 1 to 3 carbon atoms.

18 Claims, No Drawings

PROCESS FOR THE DYEING OF POLYAMIDE FIBERS WITH SULPHUR DYESTUFFS

The invention relates to a process for single bath dyeing of polyamide fibers and blends of polyamide and cellulose fibers with sulphur dyestuffs which allows the preparation of normally deep color tones on the polyamide fiber and uniform dyeings of blends of polyamide and cellulose fibers.

According to the customary dyeing processes, cellulose fibers may be dyed with most of the sulphur dyestuffs and polyamide fibers are dyed with sulphur dyestuffs either generally very poorly or not at all.

The few sulphur dyestuffs which may be used for dyeing polyamide materials according to the customary methods are by no means sufficient to achieve all of the desired shades. In addition, even with these dyestuffs, the affinity for polyamide materials is inferior to the affinity for cellulose fibers, so that dyestuff losses set in and uniform dyeings on mixed fibers of polyamide and cellulose are only achieved with difficulty. However, since the sulphur dyestuffs are extremely commercially interesting because they display good color and technical properties, there have been repeated efforts to find methods which permit the largest number of sulphur dyestuffs possible to be applied to polyamide fibers.

According to the teaching of German Patent Publication 818,041 it is possible to dye polyamide fibers when working with a concentration of sulphur dyestuff which is at least 50% of the weight of the goods. This process considerably increases dyeing costs because of the required high concentration of sulphur dyestuff and the procedural use of sodium hydrogen sulphite and ammonia in place of sodium sulphite as the reducing agent. Consequently, this process has not really achieved any practical importance.

It is also possible to dye polyamide fibers with sulphur dyestuffs in accordance with German Patent Publication 1,058,017 if the fibers are pretreated with natural or synthetic tanning agents such as disclosed, for example, in that German published application. Such processing prior to the dyeing process is an additional procedure which also increases costs. Consequently, this process has not achieved any great practical importance.

Unexpectedly, it has now been found that polyamide fibers or blends of polyamide and cellulose fibers may be readily dyed in a single bath to deep, dark color tones if the dyeing is carried out in the presence of certain dye accelerators. Suitable dye accelerators generally include derivatives of aromatic carboxylic acids, particularly compounds of the formula

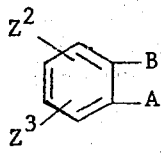

(I)

wherein:

A taken separately is hydrogen, halogen, hydroxy or alkoxy or alkyl having 1 to 4 carbon atoms;

B taken separately is $—COOR^1$ or $—Y—Z^1—M$ or

A and B taken together are of the formula

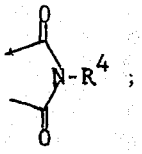

Y is a direct bond, —O—, —S— or —CO—;

$Z^1$ is alkylene having 1 to 4 carbon atoms or alkenylene having 2 to 4 carbon atoms;

M is $—COOR^2$ or

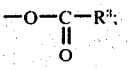

$Z^2$ is hydrogen, halogen, hydroxy or alkyl or alkoxy having 1 to 4 carbon atoms;

$Z^3$ is hydrogen, halogen, hydroxy, alkyl or alkoxy having 1 to 4 carbon atoms or when B is $—COOR^1$, $Z^3$ may be $—COOR^1$;

$R^1$ and $R^2$ are the same or different and are alkyl having 1 to 6 carbon atoms; alkenyl having 2 to 6 carbon atoms; one of said alkyl or alkenyl radicals substituted by alkoxy-alkoxy having 2 to 8 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by halogen, hydroxy or alkoxy or alkyl having 1 to 4 carbon atoms;

$R^3$ is alkyl having 1 to 8 carbon atoms and $R^4$ is hydrogen, alkyl having 1 to 8 carbon atoms, phenyl, alkenyl having 2 to 4 carbon atoms or haloalkyl, dihaloalkyl, cyanoalkyl, hydroxyalkyl, alkanoyloxyalkyl, alkoxyalkyl or phenylalkyl, each alkyl moiety having 1 to 3 carbon atoms.

Compounds of formula I wherein B is $—COOR^1$ have the formula

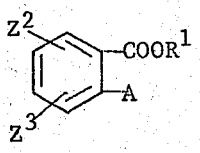

(II)

wherein A, $R^1$, $R^2$ and $Z^3$ have the above-stated meaning.

The preferred compounds of formula II include those wherein

A is hydrogen;

$Z^2$ is hydrogen or halogen, preferably chlorine, hydroxy, alkyl having 1 to 2 carbon atoms or alkoxy having 1 to 2 carbon atoms;

$Z^3$ is one of said moieties defining $Z^2$ or $—COOR^1$ and $R^1$ is alkyl having 1 to 6 carbon atoms; alkenyl having 2 to 6 carbon atoms; one of said alkyl or alkenyl radicals substituted by alkoxy-alkoxy having 3 to 6 carbon atoms, halogen, hydroxy or alkoxy having 1 to 4 carbon atoms; phenyl; benzyl; phenethyl; phenoxyethyl or phenyl, benzyl, phenethyl or phenoxyethyl having their phenyl nuclei substituted by chlorine, hydroxy, methoxy or methyl.

Examples of A, $Z^2$ and $Z^3$ include hydrogen, chlorine, bromine, hydroxy, methyl, ethyl, propyl, isopropyl, n-butyl-(1), n-butyl-(2), 2-methylpropyl-(1), methoxy, ethoxy, propoxy, isopropoxy, n-butoxy, n-butyl-(2)-oxy and 2-methylpropyl-(1)-oxy.

Examples of $R^1$ include methyl, ethyl, propyl, isopropyl, n-butyl-(1), n-butyl-(2), 2-methylpropyl-(1), 2-methylpropyl-(2), amyl-(1), amyl-(2), amyl-(3), 2-methylbutyl-(1), 2-methylbutyl-(2), 2-methylbutyl-(3), 2-methylbutyl-(4), 2,2-dimethylpropyl, hexyl, isohexyl, vinyl, allyl, crotyl, butene-(3)-yl-(1), butene-(1)-yl-(1), 2-methylpropene-(2)-yl-(1), pentenyl, hexenyl, methoxyethyl, ethoxyethyl, propoxyethyl, isopropoxyethyl, butoxyethyl, n-butyl-(2)-oxyethyl, 2-methoxypropyl-(1), 3-methoxypropyl-(1), 2,3-dimethoxypropyl-(1), 2-ethoxypropyl-(1), 3-propoxypropyl-(1), 3-propoxypropyl-(2), 3-butoxypropyl-(1), 3-butoxypropyl-(2), 2-methoxybutyl-(1), 1-methoxybutyl-(2), 4-ethoxybutyl-(1), methoxyamyl, ethoxyamyl, methoxyhexyl, (methoxyethoxy)-ethyl, 3-(methoxyethoxy)-propyl-(1), 3-(methoxyethoxy)-propyl-(2), 4-(methoxyethoxy)-butyl-(1), 4-(methoxyethoxy)-propyl-(2), 4-(methoxyethoxy)-butyl-(3), 2-(methoxyethoxy)-butyl-(3), (methoxyethoxy)-amyl, (methoxyethoxy)-hexyl, (ethoxyethoxy)-ethyl, 3-(propoxyethoxy)-propyl-(1), 3-(propoxyethoxy)-propyl-(2), 4-(ethoxyxmethoxy)-butyl-(1), 4-(ethoxymethoxy)-butyl-(2), or 4-(ethoxymethoxy)-butyl-(3), 3-(ethoxypropoxy)-ethyl, 3-(ethoxypropoxy)-propyl-(1), 3-(ethoxypropoxy)-propyl-(2), (butoxyethoxy)-ethyl, 3-(butoxyethoxy)- propyl-(1),3-(butoxyethoxy)-propyl-(2),3-(1-ethoxy-but-2-oxy)-propyl-(1), 3-(1-ethoxy-but-2-oxy)-propyl-(2), (1-ethoxy-but-4oxy)-ethyl, phenoxyethyl, p-chlorophenoxyetyl, o-, m- and p-methylphenoxyethyl, m-methoxyphenoxyethyl, 3-(m-hydroxyphenoxy)-propyl-(1), 4-(o-methylphenoxy)-butyl-(1),4-(o-methylphenoxy)-butyl-(2), 4-(o-methylphenoxy)-butyl-(3), 2-(m-chlorophenoxy)-butyl-(1), 2-(m-chlorophenoxy)-butyl-(3), 2-(m-chlorophenoxy)-butyl-(4) phenoxyhexyl, 2-(m-chlorophenoxy)-butyl-(3), benzyl, o-, m- and p-chlorobenzyl, o-, m- and p-hydroxy-, p-methoxy- and p-methylbenzyl, phenethyl, p-chloro, p-hydroxy-, p-methoxy- and p-methylphenethyl, m-chloro-phenethyl, m-methoxyphenethyl, o-methylphenethyl, m-hydroxy-phenethyl, 3-(p-chlorophenyl)-propyl-(1), 3-(m-methoxyphenyl)-propyl-(2), 4-(o-hydroxyphenyl)-butyl-(1), 4-(o-hydroxyphenyl)-butyl-2), 4-(o-hydroxyphenyl)-butyl-(3), 2-(p-methylphenyl)-butyl-(1), 2-(p-methylphenyl)-butyl-(3), 2-(p-methylphenyl)-butyl-(4), phenylpentyl, phenyl-hexyl, phenyl, o-, m- and p-chlorophenyl, o-, m- and p-methylphenyl, o-, m- and p-hydroxyphenyl and o-, m- and p-methoxyphenyl.

In the event $Z^2$ and $Z^3$ are the same or different and are hydrogen, chlorine, hydroxy, alkyl having 1 to 2 carbon atoms or alkoxy having 1 to 2 carbon atoms, those compounds of formula II are particularly suitable wherein:

$R^1$ is alkyl or alkenyl having up to 3 carbon atoms; one of said alkyl or alkenyl radicals substituted by alkoxyalkoxy having 3 to 4 carbon atoms, halogen, hydroxy or alkoxy having 1 to 4 carbon atoms; phenyl or phenyl substituted by hydroxy or methyl.

Particularly preferred are those compounds wherein:

$R^1$ is alkyl or alkenyl having up to 3 carbon atoms or one of said alkyl or alkenyl radicals substituted by halogen, hydroxy or alkoxy having 1 to 2 carbon atoms.

However, if compounds of formula II are employed wherein:

$Z^2$ is hydrogen or hydroxy;

$Z^3$ is hydrogen, chlorine, hydroxy, alkyl having 1 to 2 carbon atoms or alkoxy having 1 to 2 carbon atoms, particularly advantageous compounds include those wherein:

$R^1$ is alkyl having 1 to 4 carbon atoms; alkenyl having 2 to 4 carbon atoms; one of said alkyl or alkenyl radicals substituted by alkoxy-alkoxy having 3 to 6 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by hydroxy or methyl.

The broadest range of application pertains to those compounds immediately above wherein $R^1$ is free of phenyl moieties and may be substituted by alkoxy-alkoxy having 3 to 4 carbon atoms.

In the event $Z^3$ of formula II is —$COOR^1$, there result derivatives of phthalic acid, isophthalic acid and terephthalic acid diesters. The preferred group of aromatic dicarboxylic acid diesters has the formula:

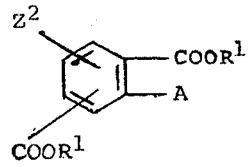

(IIa)

wherein $R^1$, A and $Z^2$ are as aforesaid.

Of the compounds of formula IIa, particularly preferred compounds for the process of this invention include those wherein:

A is hydrogen;

$Z^2$ is hydrogen, hydroxy, alkyl having 1 to 2 carbon atoms or alkoxy having 1 to 2 carbon atoms and $R^1$ is alkyl or alkenyl having up to 4 carbon atoms; one of said alkyl or alkenyl radicals substituted by alkoxy-alkoxy having 3 to 4 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by hydroxy or methyl.

The broadest range of application pertains to those compounds from the foregoing group wherein:

$Z^2$ is hydrogen or hydroxy and $R^1$ is alkyl or alkenyl having up to 2 carbon atoms or one of said alkyl or alkenyl radicals substituted by halogen, hydroxy or alkoxy having 1 to 2 carbon atoms.

Of the compounds of formula I, wherein the substituent B is -Y-$Z^1$-M, those wherein A is hydrogen are preferred, i.e., those of the formula:

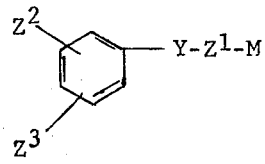

(III)

wherein M, Y, $Z^1$, $Z^2$ and $Z^3$ are as aforesaid.

The preferred compounds of formula III include those wherein:

Y is a direct bond, —O— or —CO—;

$Z^1$ is alkylene having 1 to 4 carbon atoms or alkenylene having 2 to 4 carbon atoms;

M is $—COOR^2$ or $$-O-\underset{\underset{O}{\|}}{C}-R^3;$$

$Z^2$ and $Z^3$ are the same or different and are hydrogen, halogen, preferably chlorine, hydroxy or alkyl or alkoxy having 1 to 4 carbon atoms;

$R^2$ is alkyl or alkenyl having up to 4 carbon atoms; one of said alkyl or alkenyl radicals substituted by alkoxy-alkoxy having 3 to 6 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by chlorine, hydroxy, methoxy or methyl and $R^3$ is alkyl having 1 to 4 carbon atoms.

Examples of $Z^1$ include methylene, ethylene, propylene-(1,3), propylene-(1,2), butylene-(1,2), butylene-(1,3), butylene-(1,4), 2-methylpropylene-(1,2), 2-methylpropylene-(1,3), -CH=CH-, $—CH=CH—CH_2—$, $—CH_2—CH=CH—$, $—CH_2—CH=CH—CH_2—$, $—CH=CH—CH_2—CH_2—$, $—CH_2—CH_2—CH=CH—$, $$-CH_2-\overset{\overset{CH_2}{\|}}{C}-CH_2-,\quad -CH_2-\overset{\overset{CH_3}{|}}{C}=CH-\quad \text{and} \quad -CH=\overset{\overset{CH_3}{|}}{C}-CH_2-.$$

The following radicals illustrate $—Y—Z^1—M$:

$—CH_2—COOR^2$, $—CH_2—O—CO—R^3$, $—CH_2—CH_2—COOR^2$, $—CH_2—CH_2—O—CO—R^3$, $—CH=CH—COOR^2$, $—CH=CH—O—COR^3$, $—CH_2—CH_2—CH_2—COOR^2$, $—CH_2—CH_2—CH_2—O—CO—R^3$, $$-CH_2-\underset{\underset{CH_3}{|}}{CH}-COOR^2,\quad -CH_2-\underset{\underset{CH_3}{|}}{CH}-O-CO-R^3,\quad -\overset{\overset{CH_2-CH_3}{|}}{CH}-CH_2-COOR^2,$$

$—CH=CH—CH_2—COOR^2$, $—CH_2—CH=CH—COOR^2$, $—CH=CH—CH_2—O—COR^3$, $—CH_2—CH_2—CH_2—COOR^2$, $$-CH_2-\underset{\underset{CH_3}{|}}{CH}-CH_2-O-COR^3,$$

$—O—CH_2—COOR^2$, $—O—CH_2—O—CO—R^3$, $—O—CH_2—CH_2—O—CO—R^3$, $—O—CH=CH—COOR^2$, $—O—CH=CH—O—CO—R^3$, $—O—CH_2—CH_2—COOR^2$, $—O—CH_2—CH_2—CH_2—O—CO—R^3$, $$-O-CH_2-\underset{\underset{CH_3}{|}}{CH}-COOR^2,\quad -O-CH_2-\underset{\underset{CH_3}{|}}{CH}-O-CO-R^3,$$

$—O—CH=CH—CH_2—COOR^2$, $—O—CH_2—CH=CH—COOR^2$, $—O—CH=CH—CH_2—O—CO—R^3$, $—O—CH_2—CH_2—CH_2—CH_2—COOR^2$, $$-O-CH_2-\underset{\underset{CH_3}{|}}{CH}-CH_2-O-COR^3,$$

$—CO—CH_2—COOR^2$, $—CO—CH_2—O—CO—R^3$, $—CO—CH_2—CH_2—COOR^2$, $—CO—CH_2—CH_2—O—CO—R^3$, $—CO—CH=CH—COOR^2$, $—CO—CH=CH—O—Co—R^3$, $—CO—CH_2—CH_2—CH_2—COOR^2—CO—CH_2—CH_2—O—CO—R^3$, $$-CO-CH_2-\underset{\underset{CH_3}{|}}{CH}-COOR^2,\quad -CO-CH_2-\underset{\underset{CH_3}{|}}{CH}-O-CO-R^3,$$

$—CO—CH=CH_2—COOR^2$, $—CO—CH_2—CH=CH—COOR^2$, $—CO—CH=CH—CH_2—0—CO—R^3$, $—O—CH_2—CH_2COOR^2$, $—CO—CH_2—CH_2—CH—_{CH2}—COOR^2$ and $$-CO-CH_2-\underset{\underset{CH_3}{|}}{CH}-CH_2-O-COR^3.$$

Examples for $R^2$ are the same as given above for $R^1$.

Examples for $R^3$ include methyl, ethyl, propyl, isopropyl, n-butyl-(1), n-butyl-(2), 2-methylpropyl-(1) and 2-methylpropyl- (2).

Among the compounds of formula III wherein M is $—COOR^2$, particularly addvantageous for the novel process are those compounds wherein $Z^1$ has a maximum of 2carbon atoms, $Z^2$ is hydrogen, $Z^3$ is hydrogen or hydroxy and $R^2$ is alkyl or alkenyl having 1 to 4 carbon atoms which may be substituted by halogen, hydroxy, alkoxy having 1 to 4 carbon atoms or by alkoxy-alkoxy with a total of 3 to 4 carbon atoms; phenyl or benzyl wherein the phenyl nuclei may be substituted by hydroxy or methyl, particularly those wherein $R^2$ is alkyl or alkenyl having up to 2 carbon atoms which may be substituted by halogen, hydroxy or methoxy.

Of the group of compounds of the formula III, wherein M is of the formula $$-O-\underset{\underset{O}{\|}}{C}-OR^3,$$

particularly advantageous for the novel process are those compounds wherein $Z^1$ has a maximum of 2 carbon atoms, $Z^2$ is hydrogen, $Z^3$ is hydrogen, hydroxy or alkyl or alkoxy having 1 to 2 carbon atoms and $R^3$ is alkyl having 1 4 carbon atoms. Especially preferred are compounds wherein $Z^3$ is hydrogen or hydroxy and $R^3$ is alkyl having 1 to 2 carbon atoms.

Of the compounds of formula 1, wherein A and B together form a bivalent radical of the formula

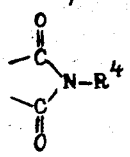

Those are preferred wherein $Z^2$and $Z^3$ are hydrogen. Accordingly, they correspond to the formula

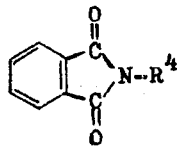

(IV)

wherein $R^4$ is hydrogen; alkyl having 1 to 8 carbon atoms; alkenyl having 2 to 4 carbon atoms; monohalo- or dihaloalkyl having 1 to 4 carbon atoms wherein chlorine and bromine are preferred as the halogen or cyanoalkyl, hydroxyalkyl, alkanoyloxyalkyl or alkoxyalkyl, each alkyl moiety having 1 to 3 carbon atoms.

The particularly preferred compounds of formula IV are those wherein $R^4$ is hydrogen; alkyl having 1 to 8 carbon atoms; monochloroalkyl or dichloroalkyl having 1 to 4 carbon atoms or cyanoalkyl, hydroxyalkyl, acetoxyalkyl, propionyloxyalkyl, methoxyalkyl or ethoxyalkyl having 1 to 3 carbon atoms in each alkyl moiety.

Examples of $R^4$ include methyl, ethyl, propyl, isopropyl, n-butyl-(1), n-butyl-(2), 2-methylpropyl-(1), 2-methylpropyl-(2), amyl-(1), amyl-(2), amyl-(3), 2-methylbutyl-(1), 2-methylbutyl-(2), 2-methylbutyl-(3), 2-methylbutyl-(4), 2,2-dimethylpropyl, hexyl, isohexyl, heptyl, octyl, chloromethyl, 2-chloroethyl-(1), 2-chloroethyl-(2), 2-bromoethyl-(1), 2-chloropropyl-(1), 3-chloropropyl-(1), 2,3-dichloropropyl-(1), 3-bromopropyl-(1), 3-chloro-2-methylpropyl-(1), 2-chlorobutyl-(1), 3-chlorobutyl-(1), 4-chlorobutyl-(1), hydroxymethyl, 2-hydroxyethyl, 2-, 3-hydroxypropyl-(1), 1-hydroxypropyl-(2), 2-hydroxy-3-chloropropyl-(1), 2-cyanoethyl-(1), 2-cyanopropyl-(1), 3-cyanopropyl-(1), 1-cyanopropyl-(2), benzyl, phenethyl and phenyl.

The compounds of formula I are known or may be prepared by the same processes used to prepare the known compounds.

The dyeing of the polyamide fibers or of the polyamide-cellulose mixed fibers is carried out in a manner customary for dyeing with sulfur dyestuffs. For this purpose, the fiber materials are dyed in aqueous dye liquor in a liquor ratio of 1:5 to 1:30 and preferably 1:10 to 1:20 at 60 to 130° C and preferably at 90°–110° C. The duration of dyeing is adjusted according to the color depth desired and the absorption rate of the dyestuff. Generally it is 1 to 2 hours. After the dyeing, the goods are washed and the dye is fixed on the fibers as usual by an oxidation process, e.g. by exposing the dyed goods to air or by means of oxidation agents, such as hydrogen peroxide, alkali metal bichromate or the like.

The aqueous dye liquors employed are obtained by converting the sulfur dyestuffs, both the water-insoluble type reticulated by disulfide bridges, as well as the water-soluble type containing thiosulfate groups and the reduced water-dispersable types, into the water-soluble leuco forms containing mercaptide groups by heating with dilute aqueous solutions of reducing agents. A large number of the commerical sulfur dyestuffs may be used for this process. The utility of a sulfur dyestuff being considered may be determined by simple testing.

A few examples of the sulfur dyestuffs, which may be employed in accordance with the process of this invention, are given in the following table:

| Name of Sulfur Dyestuff | Color Index No. |
|---|---|
| Immedial Light Yellow GWL | 53,160 |
| Immedial Yellow RR | 53,120 |
| Immedial Light Brown BTL | 53,285 |
| Immedial Light Blue FBL | 53,470 |
| Immedial Light Blue 7G | 53,540 |
| Immedial Light Blue BT | 53,235 |
| Immedial Light Gray B | 53,520 |
| Immedial Indone RR | 53,440 |
| Immedial Light Brilliant Green BBL | — |
| Immedial Red 2G | — |
| Immedial Yellow D | 53,010 |
| Immedial Maroon B | 53,710 |
| Immedial Light Green BTN | 53,550 |
| Immedial Orange-Brown RR | 53,015 |
| Immedial Yellow-Brown G | 53,055 |
| Immedial Light Brown GGL | 53,327 |
| Immedial Black-Brown AN | 53,245 |
| Immedial Light Bordeaux 3BL | 53,810 |
| Immedial Direct Blue RL | 53,235 |
| Immedial Light Green BB | 53,571 |
| Immedial Green GG | 53,570 |

The water-soluble sulfur dyestuffs containing thiosulfuric acid groups, which may be prepared from the products given in the table by reaction with aqueous sodium sulfite solutions or the dispersible sulfur dyestuffs preparable therefrom by reduction with sodium sulfide may equally serve as examples of sulfur dyestuffs whicy may be employed in accordance with the novel process.

For the reduction of the sulfur dyestuffs, all reducing agents suitable therefor are considered in principle to the extent that they correspond to the requirements of the dyestuff used, i.e. on the one hand, having the reducing potential required for the dyestuff; on the other hand, not leading to the over-reduction and consequently to the disruption of the dyestuff. Suitable reducing agents are, for example, sodium dithionite, sodium sulfoxylate-formaldehyde adduct, sodium sulfoxylate-acetaldehyde adduct and glucose. The preferred reducing agents are alkali metal sulfides, such as sodium sulfide.

The liquors are maintained alkaline when necessary by the addition of alkaline materials, preferably sodium hydroxide or sodium carbonate, and may contain a neutral salt, such as sodium sulfate or sodium chloride, depending on the properties of the dyestuff employed.

To these liquors are added the dye accelerators of formula I, particularly those of formulae II, III and IV.

The quantities of accelerators used depend on the dyestuff employed and generally are not under 2 g per l liquor and, for economic reasons, not above 20 g per l. Amounts of 5 to 15 g per l. are preferably used.

The addition may occur in the form of pure compounds or in the form of emulsified preparations. The emulsified preparations are obtained by mixing the pure dye accelerators with dispersing agents, if necessary with the utilization of inert, liquid diluting agents, such as isobutanol. Depending on the consistency of the components to be mixed, the composition may be prepared and homogenized by kneading, stirring or melting using, if necessary, elevated temperatures.

Suitable as emulsifiers are the commercial non-ionic emulsifiers such as the alkoxylation products, particularly the ethoxylation products of castor oil, higher fatty alcohols, fatty acids, fatty acid amides, fatty amines or alkyl phenols. It is equally possible to work with anionic emulsifiers, e.g. alkyl or alkylaryl sulfonates or sulfates in the form of their alkali metal, alkali earth metal, ammonium or alkylammonium salts. The use of mixtures of the stated classes of emulsifiers is also very advantageous.

The dye accelerators, used according to the invention, are employed with the stated emulsifiers or emulsifier compositions in the form of 60–95% by weight, and preferably 80–90% by weight, standards.

The process of this invention makes possible, under the stated conditions, production of normally deep and even dyeings on polyamide as well as even-shaded dyeing of fiber blends of polyamide and cellulose with a great number of commercial sulfur dyestuffs. In using sulfur dyestuffs which dye polyamide fibers evenly without the stated auxiliary agents, considerable dye efficiency increases may be achieved by utilizing said auxiliary agents.

The fastnesses of the dyeings obtained on the polyamide and cellulose fibers are practically equal. There is obtained average to very good fastnesses to light and wet processing.

The following examples are for the purpose of illustrating the present invention.

EXAMPLE 1

Twenty-five g of a precleaned blend of polyamide and staple fiber (50:50) are dyed in a liquor which was obtained by dissolving 1.25 g Immedial Direct Blue RL, extra concentrated (Colour Index No. 53,235), in a solution of 1.6 g sodium sulfide (60% technical product) in 500 ml water and adding 4 g of a composition of 85 g benzoic acid methyl ester, 7.5 g hydroxyethylated castor oil with 36 ethylene oxide units, 5.0 g calcium salt of dodecylbenzenesulfonic acid and 2.5 g isobutanol.

The dyeing takes place in a closed laboratory dyeing apparatus beginning at 30° C with a slow rise in temperature to 100° C. At this temperature, the dyeing proceeds for 1 hour. Subsequently, the dyeing is washed and oxidized with sodium bichromate or hydrogen peroxide.

There is obtained an even-shaded dyeing of both fibers of a deep marine blue. Without the addition of the benzoic acid methyl ester, the polyamide fiber remains practically undyed.

The same results are achieved if, in place of the benzoic acid methyl ester, there is employed the n-propylester, n-hexyl ester, methyl-glycol ester, butylglycol ester or ethyldiglycol ester of benzoic acid.

EXAMPLE 2

Twenty-five g of precleaned knitted material of polyamide and cotton (50:50) are dyed in a liquor, which is prepared by dissolving 1.25 g Immedial Light Maroon 3BL (C.I. No. 53,810) in a solution of 0.63 g sodium sulfide (60% technical product) in 500 ml water and adding 5 g of a composition of 85 g 4-chlorobenzoic acid methylglycol ester and 15 g hydroxyethylated stearyl alcohol with 14 ethyleneoxide units.

The dyeing takes place in a closed laboratory dyeing apparatus with a temperature gradation from 30° to 95° C. Upon achieving the final temperature, the dyeing proceeds at this temperature for one hour. Subsequently the dyeing is washed and oxidized with sodium bichromate or hydrogen peroxide. On both types of fiber is obtained a brownish red dyeing alike in shade.

The same results are achieved, if in place of the 4-chlorobenzoic acid methylglycol ether, there is used the ethyl ester or n-butyl ester of 4-methylbenzoic acid, 3-methoxy benzoic acid methyl glycol ester, 4-chlorobenzoic acid n-butyl ester, 3-methylbenzoic acid ethyl ester or the 4- or 3-methoxybenzoic acid methyl ester.

EXAMPLE 3

Five hundred g precleaned Perlon yarn on a cross coil are dyed in a liquor, which was obtained by dissolving 25 g Immedial Light Brown BTL, concentrated (C.I. No. 53,285), in a solution of 32.5 g sodium sulfide (60% technical product) and 10 g of the adduct of sodium sulfoxylate and acetaldehyde in 5 l. water and adding 75 g of a composition of 90 g 2-hydroxy-3-methylbenzoic acid methyl ester and 10 g hydroxyethylated octadecylamine with 15 ethylene oxide units.

The dyeing takes place in a closed laboratory dyeing apparatus for cross coils. The temperature is raised from 30° C up to 110° C, the dyeing proceeding at the latter temperature for one hour. Thereupon the dyeing is cooled to 80° C, washed, and oxidized at 80° C in an acidic medium with sodium bichromate. There is obtained an even, deep dyeing having a good dyeing efficiency. Without the addition of the dye accelerator, there is obtained only a very weak coloration of the material, which is practically useless.

If the n-propyl or n-amyl ester of 2-hydroxy-3-methylbenzoic acid, the methyl, methylglycol or butylglycol ester of 3-chloro-4-methylbenzoic acid, 2-hydroxybenzoic acid methyl ester or 2,4-dichlorobenzoic acid methyl ester is used in place of the 2-hydroxy-3-methylbenzoic acid methyl ester, there is obtained an equally good dyeing effect.

EXAMPLE 4

Twenty-five g of a precleaned mixed fabric of polyamide and staple fiber (50:50) are dyed in a liquor which was obtained by dissolving 1.25 g Immedial Light Gray B (C.I. No. 53,520) in a solution of 1.0 g sodium sulfide (60% technical product) in 500 ml water and adding 4 g of a composition of 80 g benzoic acid 2-hydroxyethyl ester, 10 g hydroxyethylated castor oil with 36 ethylene oxide units, 6.6 g calcium salt of dodecylbenzenesulfonic acid and 3.4 g isobutanol. The dyeing takes place in a closed laboratory dyeing apparatus. The dye temperature, dyeing time and oxidation correspond to that described in Example 1.

On both types of fibers, there is obtained an even gray dyeing, alike in shade with good dyeing efficiency. Without the use of said auxiliary agent, the cellulose fiber is dyed well; the polyamide fiber, however, only slightly. In like manner, benzoic acid-2- or -3-hydroxypropyl ester may be employed in place of benzoic acid-2-hydroxyethyl ester.

Very good dyeing efficiency and even dyeings are also produced by isophthalic-acid or terephthalic acid-bis-2-hydroxyethyl ester or -bis-2- or -3-hydroxypropyl ester. Equally good and even dyeings are obtained by the use of phthalic acid dimethyl- or -diethyl esters or by the use of terephthalic acid dimethyl ester.

EXAMPLE 5

Five hundred g of precleaned Perlon yarn on a cross coil are dyed in a liquor which was obtained by dissolving 25 g Hydrosol Blue FFG (C.I. No. 53,470) in a solution of 15.0 g sodium sulfide (60% technical product) and 50 g sodium sulfate in 5 l. water and adding 25 g of a composition of 85 g benzoic acid-2-hydroxyphenyl ester and 15 g hydroxyethylated nonylphenol with 14 ethylene oxide units.

The dyeing takes place in a closed laboratory dyeing apparatus for cross coils. The temperature rises from 30° C up to 95° C and the dyeing proceeds at the latter temperature for 1 hour. Thereupon the dyeing is cooled to 80° C, washed and oxidized at 80° C in an acidic medium with sodium bichromate.

By addition of benzoic acid 2-hydroxyphenyl ester, the dyeing efficiency is increased by about 50% in comparison to a dyeing without this dye accelerator.

Equally good dyeings are obtained if benzoic acid phenyl ester, 4-chlorobenzoic acid- or 4-methylbenzoic acid phenyl ester, benzoic acid 4-chlorophenyl ester or benzoic acid 4-hydroxyphenyl ester is used in place of the benzoic acid 2-hydroxyphenyl ester.

It is also possible to use benzoic acid β-phenoxyethyl ester, 4-methylbenzoic acid- or 4-chlorobenzoic acid-β-phenoxyethyl ester in order to achieve dyeings of similar depth and evenness.

EXAMPLE 6

Five hundred g of precleaned Perlon yarn on a cross coil are dyed in a liquor which was obtained by dissolving 25 g Hydrosol Yellow RR (C.I. No. 53,121) in a solution of 20.0 g sodium sulfide in 5 l. water and adding 40 g of a composition of 90 g phenyl acetic acid methyl ester and 10 g hydroxyethylated stearyl alcohol with 14 ethylene oxide units.

The dyeing proceeds in a closed laboratory dyeing apparatus for cross coils. The temperature is raised from 30° C up to 105° C and the dyeing proceeds at the latter temperature for 1 hour. Thereupon the dyeing is cooled to 80° C, washed and oxidized at 80° C in an acidic medium with sodium bichromate. An even, deep dyeing is obtained having a good dyeing efficiency.

In order to achieve equally good dyeing results, it is also possible to use phenyl acetic acid benzyl ester, phenyl acetic acid 4-chlorophenyl ester, phenyl acetic acid 4-methyl-phenyl ester, 4-chlorophenyl acetic acid n-propyl ester, 4-methyl-phenyl acetic acid methyl ester, 2-phenyl butyric acid methyl ester, benzoyl acetic acid methyl ester, benzoyl acetic acid n-butyl ester, 4-chlorobenzoyl acetic acidethylether, 4-methoxybenzoyl acetic acid ethyl ester, 4-methylbenzoyl acetic acid ethyl ester, cinnamic acid methyl ester or cinnamic acid ethyl ester in place of the phenyl acetic acid methyl ester.

EXAMPLE 7

Twenty-five g of a precleaned mixed fabric of polyamide and staple fiber (50:50) are dyed in a liquor which was prepared by dissolving 1.25 g Hydrosol Light Blue FFR (C.I. No. 53,471) in a solution of 1.0 g sodium sulfide in 250 ml water and adding 0.75 g of a composition of 80 g β-phenoxypropionic acid ethyl ester, 10 g hydroxyethylated castor oil with 36 ethylene oxide units, 6.6 g calcium salt of dodecylbenzenesulfonic acid and 3.4 g isobutanol.

The dyeing takes place in a closed laboratory dyeing apparatus beginning at 30° C with a slow rise of the temperature to 100° C. At this temperature, dyeing proceeds for 1 hour. Subsequently, the dyeing is washed at 80° C and oxidized in an acidic medium with sodium bichromate.

Compared to a dyeing without β-phenoxypropionic acid ethyl ester, there is obtained according to this example an increase of the dyeing efficiency on the polyamide fiber of about 30%.

Practically the same results are achieved if β-3-chlorophenoxypropionic acid methyl ester, β-4-methylphenoxypropionic acid n-propyl ester, β-phenoxypropionic acid phenyl ester, phenoxy acetic acid ethyl ester, 4-chlorophenoxy acetic acid ethyl ester or 2-methylphenoxy acetic acid ethyl ester is employed in place of the β-phenoxypropionic acid ethyl ester.

EXAMPLE 8

Five hundred g precleaned Perlon yarn on a cross coil are dyed in a liquor which was prepared by dissolving 25 g Hydrosol Light Green 3B (C.I. No. 53,572) in a solution of 15.0 g technical, 60% by weight sodium sulfide in 5 l. water and adding 40 g of a mixture of 85 g N-hexylphthalimide and 15 g hydroxyethylated octadecylamine with 12 ethylene oxide units.

The dyeing proceeds in a closed laboratory dyeing apparatus for cross coils. The temperature is raised from 30° C up to 100° C and dyeing proceeds at this temperature for 1 hour. Thereupon the dyeing is cooled to 80° C, washed and oxidized at 80° C in an acidic medium with sodium bichromate.

Compared to a dyeing without the N-hexylphthalimide, a color intensification of about 30% results according to this example.

Comparably advantageous dyeing results are achieved if the N-hexylphthalimide is substituted by N-2-ethylhexylphthalimide, N-ethylphthalimide, N-propylphthalimide, N-n-butylphthalimide, N-sec.-butylphthalimide, N-β-cyanoethylphthalimide, N-methoxymethylphthalimide, 2,3-dichloropropylphthalimide, N-methylolphthalimide, β-hydroxyethylphthalimide, N-acetoxymethylphthalimide or phthalimide.

We claim:

1. In the single bath dyeing of polyamide fibers and blends of polyamide and cellulose fibers with aqueous solutions of reduced sulphur dyestuffs wherein the fibers are dyed in an aqueous dye liquor in a liquor ratio of 1:5 to 1:30 at a temperature of from 60 to 130° C., the improvement which comprises adding to each liter of said aqueous solution 2 to 20 grams of a dye accelerator of the formula

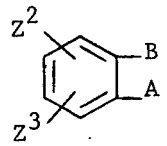

wherein:

A taken separately is hydrogen, halogen, hydroxy or alkoxy or alkyl having 1 to 4 carbon atoms;

B taken separately is —COOR¹ or —Y—Z¹—M or A and B taken together are of the formula

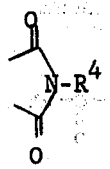

Y is a direct bond, —O—, —S— or —CO—;

Z¹ is alkylene having 1 to 4 carbon atoms or alkenylene having 2 to 4 carbon atoms;

M is —COOR² or $$-O-\underset{\underset{O}{\|}}{C}-R^3;$$

Z² is hydrogen, halogen, hydroxy or alkyl or alkoxy having 1 to 4 carbon atoms;

Z³ is hydrogen, halogen, hydroxy, alkyl or alkoxy having 1 to 4 carbon atoms or when B is —COOR¹, Z³ may be —COOR¹;

R¹ and R² are the same or different and are alkyl having 1 to 6 carbon atoms; alkenyl having 2 to 6 carbon atoms; one of said alkyl or alkenyl radicals substituted by alkoxy-alkoxy having 2 to 8 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by halogen, hydroxy or alkoxy or alkyl having 1 to 4 carbon atoms;

R³ is alkyl having 1 to 8 carbon atoms and

R⁴ is hydrogen, alkyl having 1 to 8 carbon atoms, phenyl, alkenyl having 2 to 4 carbon atoms or haloalkyl, dihaloalkyl, cyanoalkyl, hydroxyalkyl, alkanoyloxyalkyl, alkoxyalkyl or phenylalkyl, each alkyl moiety having 1 to 3 carbon atoms.

2. The improved process of claim 1 wherein said dye accelerator is of the formula

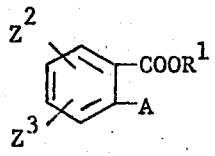

3. The improved process of claim 2 wherein

A is hydrogen;

Z² is hydrogen, halogen, hydroxy, alkyl having 1 to 2 carbon atoms or alkoxy having 1 to 2 carbon atoms;

Z³ is one of said moieties defining Z² or —COOR¹ and

R¹ is alkyl having 1 to 6 carbon atoms; alkenyl having 2 to 6 carbon atoms; one of said alkyl or alkenyl radicals substituted by alkoxy-alkoxy having 3 to 6 carbon atoms, halogen, hydroxy or alkoxy having 1 to 4 carbon atoms; phenyl; benzyl; phenethyl; phenoxyethyl or phenyl, benzyl, phenethyl or phenoxyethyl having their phenyl nuclei substituted by chlorine, hydroxy, methoxy or methyl.

4. The improved process of claim 2 wherein

A is hydrogen;

Z² and Z³ are the same or different and are hydrogen, chlorine, hydroxy, alkyl having 1 to 2 carbon atoms or alkoxy having 1 to 2 carbon atoms and R¹ is alkyl or alkenyl having up to 3 carbon atoms; one of said alkyl or alkenyl radicals substituted by alkoxy-alkoxy having 3 to 4 carbon atoms, halogen, hydroxy or alkoxy having 1 to 4 carbon atoms; phenyl or phenyl substituted by hydroxy or methyl.

5. The improved process of claim 4 wherein

R¹ is alkyl or alkenyl having up to 3 carbon atoms or one of said alkyl radicals substituted by halogen, hydroxy or alkoxy having 1 to 2 carbon atoms.

6. The improved process of claim 2 wherein

A is hydrogen;

Z² is hydrogen or hyroxy;

Z³ is hydrogen, chlorine, hydroxy, alkyl having 1 to 2 carbon atoms or alkoxy having 1 to 2 carbon atoms and R¹ is alkyl having 1 to 4 carbon atoms; alkenyl having 2 to 4 carbon atoms; one of said alkyl or alkenyl radicals substituted by alkoxy-alkoxy having 3 to 6 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by hydroxy or methyl.

7. The improved process of claim 6 wherein

R¹ is alkyl or alkenyl having up to 4 carbon atoms or one of said alkyl or alkenyl radicals substituted by alkoxy-alkoxy having 3 to 4 carbon atoms, alkoxy having 1 to 4 carbon atoms, hydroxy or halogen.

8. The improved process of claim 1 wherein said dye accelerator is of the formula

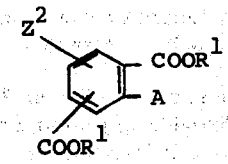

9. The improved process of claim 8 wherein

A is hydrogen;

Z² is hydrogen, hydroxy, alkyl having 1 to 2 carbon atoms or alkoxy having 1 to 2 carbon atoms and R¹ alkyl or alkenyl having up to 4 carbon atoms; one of said alkyl or alkenyl radicals substituted by alkoxy-alkoxy having 3 to 4 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by hydroxy or methyl.

10. The improved process of claim 8 wherein

A is hydrogen;

Z² is hydrogen or hydroxy and

R¹ is alkyl or alkenyl having up to 2 carbon atoms or one of said alkyl or alkenyl radicals substituted by halogen, hydroxy or alkoxy having 1 to 2 carbon atoms.

11. The improved process of claim 1 wherein said dye accelerator is of the formula

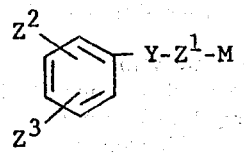

12. The improved process of claim 11 wherein
Y is a direct bond, —O— or —CO—;
$Z^1$ is alkylene having 1 to 4 carbon atoms or alkenylene having 2 to 4 carbon atoms;
M is $—COOR^2$ or $$—O—\underset{\underset{O}{\|}}{C}—R^3;$$

$Z^2$ and $Z^3$ are the same or different and are hydrogen, halogen, hydroxy or alkyl or alkoxy having 1 to 4 carbon atoms;
$R^2$ is alkyl or alkenyl having up to 4 carbon atoms; one of said alkyl or alkenyl radicals substituted by alkoxy-alkoxy having 3 to 6 carbon atoms, hydroxy, alkoxy having 1 to 4 carbon atoms or halogen; phenyl; benzyl; phenethyl; phenoxyethyl or phenyl, benzyl, phenethyl or phenoxyethyl having their phenyl nuclei substituted by chlorine, hydroxy, methoxy or methyl and
$R^3$ is alkyl having 1 to 4 carbon atoms.

13. The improved process of claim 11 wherein
Y is a direct bond, —O— or —CO—;
$Z^1$ is alkylene having 1 to 2 carbon atoms or alkenylene having 2 carbon atoms;
M is $—COOR^2$;
$Z^2$ is hydrogen;
$Z^3$ is hydrogen or hydroxy and
$R^2$ is alkyl or alkenyl having up to 4 carbon atoms; one of said alkyl or alkenyl radicals substituted by alkoxy-alkoxy having 3 to 4 carbon atoms, hydroxy, halogen or alkoxy having 1 to 4 carbon atoms; phenyl; benzyl or phenyl or benzyl having their phenyl nuclei substituted by hydroxy or methyl.

14. The improved process of claim 13 wherein
$R^2$ is alkyl or alkenyl having up to 2 carbon atoms or said alkyl or alkenyl substituted by halogen, hydroxy or methoxy.

15. The improved process of claim 11 wherein
Y is a direct bond, —O— or —CO—;
$Z^1$ is alkylene having 1 to 2 carbon atoms or alkenylene having 2 carbon atoms;
M is $$—O—\underset{\underset{O}{\|}}{C}—R^3;$$

$Z^2$ is hydrogen;
$Z^3$ is hydrogen, hydroxy or alkyl or alkoxy having 1 to 2 carbon atoms and
$R^3$ is alkyl having 1 to 4 carbon atoms.

16. The improved process of claim 15 wherein
$Z^3$ is hydrogen or hydroxy and
$R^3$ is alkyl having 1 to 2 carbon atoms.

17. The improved process of claim 1 wherein said dye accelerator is of the formula

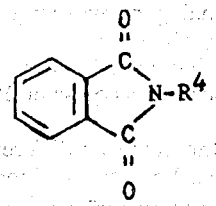

wherein
$R^4$ is hydrogen, alkyl having 1 to 8 carbon atoms; alkenyl having 2 to 4 carbon atoms; monohaloalkyl or dihaloalkyl having 1 to 4 carbon atoms or cyanoalkyl, hydroxyalkyl, alkanoyloxyalkyl or alkoxyalkyl, each alkyl moiety having 1 to 3 carbon atoms.

18. The improved process of claim 17 wherein
$R^4$ is hydrogen; alkyl having 1 to 8 carbon atoms; monochloroalkyl or dichloroalkyl having 1 to 4 carbon atoms or cyanoalkyl, hydroxyalkyl, acetoxyalkyl, propionyloxyalkyl, methoxyalkyl or ethoxyalkyl having 1 to 3 carbon atoms in each alkyl moiety.

* * * * *